United States Patent [19]

Supron

[11] Patent Number: 4,951,598

[45] Date of Patent: Aug. 28, 1990

[54] MOISTENING APPARATUS

[76] Inventor: Steven A. Supron, 11 Comstock Hill Ave., Norwalk, Conn. 06850

[21] Appl. No.: 407,391

[22] Filed: Sep. 14, 1989

[51] Int. Cl.[5] ..... B05C 1/08

[52] U.S. Cl. ..... 118/244; 118/258

[58] Field of Search ..... 118/244, 258, 267, 401

[56] References Cited

U.S. PATENT DOCUMENTS

| | | | |
|---|---|---|---|
| 2,241,104 | 5/1941 | Vander Grinten | 118/258 |
| 2,374,076 | 4/1945 | Burckhardt et al. | 137/453 |
| 2,717,574 | 9/1955 | LaBore | 118/401 |
| 3,410,713 | 11/1968 | Schneidereit | 118/259 |
| 3,948,216 | 4/1976 | Reid et al. | 118/257 |
| 3,981,270 | 9/1976 | Rogdanski | 118/257 |
| 3,995,808 | 12/1976 | Kehoe | 229/73 |
| 4,311,114 | 1/1982 | Lees et al. | 118/244 |
| 4,701,233 | 10/1987 | Beck et al. | 8/217 |
| 4,799,989 | 1/1989 | Morzullo | 156/442.1 |
| 4,816,108 | 3/1989 | Beck et al. | 156/356 |

*Primary Examiner*—Willard Hoag

*Attorney, Agent, or Firm*—Robert H. Whisker; Melvin J. Scolnick; David E. Pitchenik

[57] ABSTRACT

A moistening apparatus for moistening a form sheet. The apparatus includes a body having a trough in its top portion and a reservoir in its lower portion. A capillary tube connects the trough with the reservoir and a roller co-extensive with the trough, is mounted so that its lower portion is substantially surrounding by the trough. The apparatus is connected to a source of fluid by a gravity feed. The fluid level in the source varies between a predetermined upper and predetermined lower level such that at the lower level, fluid is always maintained in the reservoir, while at the upper level the fluid does not rise substantially above the bottom of the trough. Thus, a meniscus of fluid is maintained in the trough only by capillary action. As a form sheet moves transversely across the roller, the roller rotates through the meniscus of fluid and a sheet of fluid is transferred to the form sheet to moisten a previously applied remoistenable glue on the form sheet.

19 Claims, 1 Drawing Sheet

MOISTENING APPARATUS

RELATED APPLICATIONS

This application is one of the following group of co-pending, commonly assigned, applications, which were all filed on even date. These applications all relate to the development of an apparatus for printing, folding, and sealing a form sheet to prepare a self-mailer. T,20X

BACKGROUND OF THE INVENTION

The subject invention relates to apparatus for moistening a sheet of paper. More particularly, it relates to apparatus for moistening a form sheet which has a remoistenable glue applied to selected areas, as the form sheet is folded and sealed to prepare a self-mailer.

Self mailers, that is form sheets on which may be printed address information and message information and then folded and sealed to form a mail piece are well known. U.S. Pat. No. 3,995,808; to: Kehoe; for: UNIT CONTAINING VARIABLE MESSAGES; issued: Dec. 7, 1976 discloses a form sheet which may be used to prepare a self-mailer. The self-mailer of Kehoe may be sealed by moistening remoistenable glue applied around the edges of the form sheet.

Various systems for applying moisture to remoistenable glues are known. U.S. Pat. No. 2,717,574; to: Bore; for: GUMMED STRIP MOISTENING DEVICE; issued: Sept. 13, 1955 shows a moistening device where a gum strip passes over the upper part of an array of closely spaced parallel plates having their lower portions immersed in a reservoir of water. Capillary action between the plates carries water to the strip. U.S. Pat. No. 4,799,989; to: Marzullo; for: DOCUMENT MOISTENING DEVICE; issued: Jan. 24, 1989 shows an apparatus where a pivotable hammer urges a document against a moistened wick.

Other techniques for sealing form sheets are also known. U.S. Pat. No. 4,701,233; to: Beck et al; for: METHOD FOR FOLDING AND SEALING SHEETS; issued: Oct. 20, 1987 discloses an apparatus for folding and sealing documents produced by a facsimile system. As the documents are output from the facsimile system, they are folded and sealed by the application of glue dots to selected spots along the edges of the documents.

While such apparatus may have been satisfactory for their intended application, they have proven to have numerous disadvantages. Difficulties have arisen in maintaining a proper level of fluid in moistening apparatus as they are operated over long periods of time, and such apparatus have tended to become clogged by the transfer of adhesive from the document to the apparatus. Glue dispensing systems have proven to be expensive and complicated, generally requiring pumps to move viscous glues.

Accordingly, it is an object of the subject invention to provide a simple and economical moistening apparatus which resists clogging.

It is another object of the subject invention to provide such an apparatus which is operable over a range of fluid levels maintained in the supply system.

BRIEF SUMMARY OF THE INVENTION

The above objects are achieved and the disadvantages of the prior art are overcome in accordance with the subject invention which includes a reservoir, a roller positioned for tangential contact with a sheet as the sheet moves transversely across the roller, a trough substantially surrounding the lower portion of the roller and extending along the length of the roller, and a capillary connecting the reservoir and the trough to maintain a meniscus of fluid in the trough. Thus, as the sheet moves across the roller, the roller rotates through the meniscus to transfer a film of fluid to the sheet. Preferably, the roller is substantially smooth and impervious to minimize the transfer of adhesive from the sheet to the apparatus.

In a preferred embodiment, the apparatus is filled with gravity feed from a source where the level of fluid in the source varies between a predetermined higher and a predetermined lower level. The reservoir is positioned with respect to the source such that sufficient fluid is maintained in the reservoir when the fluid is at the lower level, and the capillary is made long enough that the bottom of the trough is substantially above the upper level. Thus, the fluid level in the trough is maintained only by capillary action and remains substantially constant despite variations in the level of the source.

Thus, it can be seen that the above objects are achieved and the disadvantages of the prior art are overcome by the subject invention. Other objects and advantages of the subject invention will be apparent to those skilled in the art from consideration of the detailed description set forth below and of the attached drawings.

DETAILED DESCRIPTION OF PREFERRED EMBODIMENTS

Figures 1, 2:
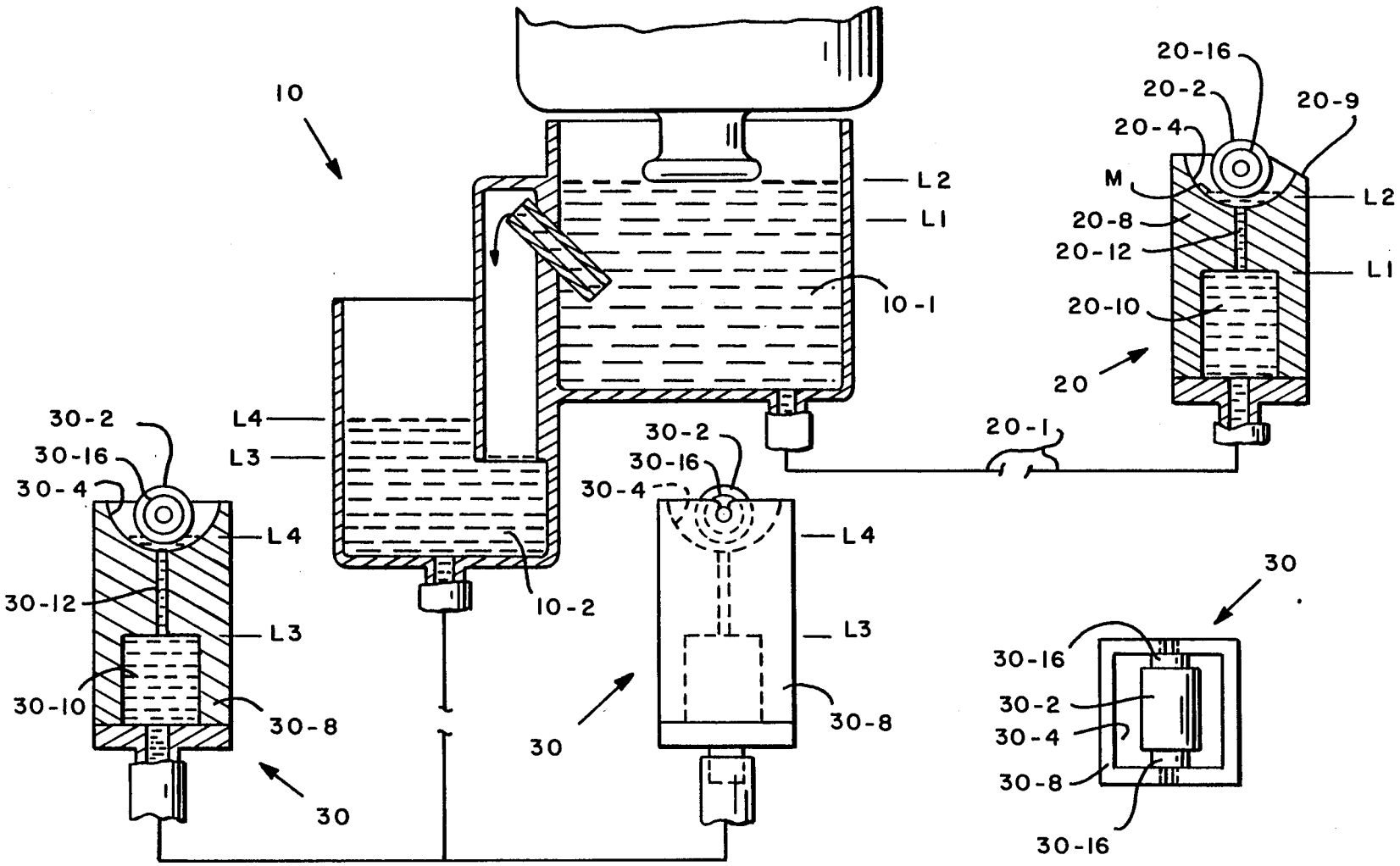
FIG. 1 shows a semi-schematic representation of a moistening system including moistening apparatus in accordance with the subject invention.
FIG. 2 shows a top plan view of moistening apparatus in accordance with the subject invention.

FIGS. 1 and 2 show a schematic representation of a preferred embodiment of the subject invention.

The embodiment shown comprises extended moistening apparatus 20, useful to moisten a transverse edge of a form as it is operated on by a folder-sealer or similar equipment, and two shorter moistening apparatus 30, which are similarly useful to moisten lateral edges of a form. A suitable application of this embodiment is described in co-pending U.S. application Serial No. (C-572).

As described in U.S. Pat. No. 2,374,076; to Burckhardt et al., which is hereby incorporated by reference, water supply system 10 maintains two reservoirs 10-1 and 10-2 for supplying moistening apparatus 20 and 30 respectively. As shown, reservoir 10-1 will vary between levels L1 and L2, while reservoir 10-2 will vary between levels L3 and L4.

Moistening apparatus 20 is connected to reservoir 10-1 by fluid supply tubing 20-1. Apparatus 20 comprises a smooth metal roller 20-2 mounted in a trough 20-4 provided in the top of body 20-8. (Roller 20-2 may also be formed with a hydrophillic surface to assist in assuring good moistening action.) The length of roller 20-2 and trough 238-4 is substantially equal to the width of the transverse edge of the form to be moistened and a bevel 20-9 is provided in body 20-8 to facilitate moistening of a trailing transverse edge as the form is withdrawn from a buckle chute as shown in the above referenced co-pending application. Body 20-8 also contains primary reservoir 20-10 which is connected to trough 20-4 by capillary 20-12. With water as the fluid capillary 20-12 is approximately 0.060 inches wide and extends substantially for the full length of trough 20-4. Reservoir 10-1 is so designed and positioned so that level L1 is sufficiently high that primary reservoir 20-10 is full and the length of capillary 20-12 is chosen with respect to level L2 so that level L2 is maintained approximately at or below the bottom of trough 20-4.

Thus, meniscus of water M is maintained at a substantially constant level in the bottom of trough 20-4 to moisten roller 20-2. As form sheet 10 moves across roller 20-2 the roller rotates through meniscus M and picks up a substantially continuous sheet of water to moisten remosenable glue on the form. It has been found that it is desirable to reduce the diameter of roller 20-2 as much as is practicable in order to assure a smooth continuous sheeting action of the water picked up by roller 20-2 from meniscus M. The lower limits of this diameter result from the need to assure a smooth continuous rotation of roller 0-2 as form sheet 10 passes across it. If the diameter becomes too small, the rotation becomes irregular and moistening is adversely affected. Diameters of between 0.12 and 0.25 inches have been found to be effective. The gap between roller 20-2 and trough 20-4 widens from approximately 0.03 inches, at the bottom, to approximately 0.125 inches so as to prevent capillary action causing trough 20-4 to overflow.

FIG. 1 also shows moistening apparatus 30 which are provided to moisten the form along the lateral edges. These apparatus are positioned with respect to levels L3 and L4 of reservoir 10-2 in the same manner as moistening apparatus 20 is positioned with respect to levels L1 and L2, and are substantially identical to apparatus 20. They differ only in that body 30-8 does not include a bevel, and in having a shorter length, and need not be discussed further here for an understanding of the subject invention.

FIG. 2 shows a top view of moistening apparatus 30. As can be seen, roller 30-2 is mounted in trough 30-4 provided in body 30-8, as described above. Hubs 30-16, approximately 0.075 inches long, are provided to prevent capillary action between the ends of roller 30-2 and the ends of trough 30-4 which, if it occurred, might cause overflow of trough 20-4. Similar hubs 20-16 are provided in apparatus 20.

The above embodiments of the subject invention have been described by way of illustration only, and other embodiments of the subject invention will be apparent to those skilled in the art from consideration of the detailed description given above and the attached drawings. Accordingly, limitations on the subject invention are to be found only in the claims set forth below.

I claim:

1. Moistening apparatus, comprising:

(a) a reservoir;

(b) a roller positioned above said reservoir for tangential contact with a sheet as said sheet moves transversely across said roller, (c) a trough substantially surrounding the lower portion of said roller and extending along the length of said roller;

(d) capillary means defining a slit orifice in said trough extending generally along the length of said roller, and connecting said reservoir and said trough for maintaining a meniscus of fluid in said trough; wherein (e) as said sheet moves across said roller said roller rotates through said meniscus to transfer a film of fluid to said sheet.

2. Apparatus as described in claim 1 wherein the dimensions of said capillary means are suitable for operation with water as said fluid.

3. Apparatus as described in claim 1 wherein said reservoir is filled by gravity feed from said source, the level of fluid in said source varying between a predetermined higher level and a predetermined lower level, said reservoir being positioned at a height such that sufficient fluid is maintained in said reservoir at said lower level, and the bottom of said trough is positioned substantially at or above said upper level.

4. Apparatus as described in claim 3 wherein the diameter of said roller is selected to small enough so that said roller effectively carrier a film of water from said trough to said sheet and large enough so that said roller is effectively driven by said transverse movement of said sheet across said roller.

5. Apparatus as described in claim 1 wherein the distance between the surface of said roller and the sides of said trough increases with the height above the bottom of the trough whereby said meniscus does not reach the top of said trough and only said film of fluid is transported out of said trough.

6. Apparatus as described in claim 5 wherein said roller further includes hubs at each end to prevent capillary action between the ends of said trough and the ends of said roller.

7. Apparatus as described in claim 6 wherein said capillary means further comprises a tube having a rectangular cross-section, the width of said tube being selected so that capillary action is maintained between said reservoir and said trough.

8. Apparatus as described in claim 7 wherein the surface of said roller is substantially smooth and impervious.

9. Apparatus as described in claim 8 wherein said width of said tube is suitable for operation with water as said fluid.

10. Apparatus as described in claim 8 wherein said reservoir is filled by gravity feed from said source, the level of fluid in said source varying between a predetermined higher level and a predetermined lower level, said reservoir being positioned at a height such that sufficient fluid is maintained in said reservoir at said lower level, and the bottom of said trough is positioned substantially at or above said upper level.

11. Apparatus as described in claim 10 wherein the diameter of said roller is small enough so that said roller effectively carries a film of said fluid from said trough to said sheet and large enough so that said roller is effectively driven by said transverse movement of said sheet across said roller.

12. Apparatus as described in claim 8 further comprising a source for maintaining a level of fluid in said reservoir sufficient to maintain said meniscus in said trough.

13. Apparatus as described in claim 12 wherein said width of said tube is suitable for operation with water as said fluid.

14. Apparatus as described in claim 12 wherein said reservoir is fillable by gravity feed from said source, the level of fluid in said source varying between a predetermined higher level and a predetermined lower level, said reservoir being positioned at a height selected so that sufficient fluid to maintain said meniscus is maintained in said reservoir at said lower level, and the bottom of said trough is positioned substantially at or above said higher level.

15. Apparatus as described in claim 14 wherein said width of said tube is suitable for operation with water as said fluid.

16. Apparatus as described in claim 14 wherein the diameter of said roller is small enough so that said roller effectively carries a film of said fluid from said trough to said sheet and large enough so that said roller is effectively driven by said transverse movement of said sheet across said roller.

17. Apparatus as described in claim 16 wherein said widths of said tube and said roller diameter are suitable for operation with water as said fluid.

18. Apparatus as described in claim 16 wherein said diameter is between approximately 0.12 inches and 0.25 inches.

19. Apparatus as described in claim 18 wherein said diameter is approximately 0.19 inches.

* * * * *